US005351573A

United States Patent [19]

Cicotte

[11] Patent Number: 5,351,573

[45] Date of Patent: Oct. 4, 1994

[54] ADJUSTABLE AUTOMOBILE PEDAL SYSTEM

[76] Inventor: Edmond B. Cicotte, 11086 Hedgeway, Utica, Mich. 48087

[21] Appl. No.: 772,326

[22] Filed: Oct. 7, 1991

[51] Int. Cl.[5] ..... G05G 1/14

[52] U.S. Cl. ..... 74/512; 74/518; 74/513; 74/560

[58] Field of Search ..... 74/512, 513, 560, 561, 74/562, 522, 525; 29/434

[56] References Cited

U.S. PATENT DOCUMENTS

| | | | |
|---|---|---|---|
| 2,860,720 | 11/1958 | Huff et al. | 180/90.6 |
| 3,151,499 | 10/1964 | Roe | 74/560 |
| 3,282,125 | 11/1966 | Dully | 74/560 |
| 3,301,088 | 1/1967 | White | 74/560 |
| 3,400,607 | 10/1968 | Smith | 74/560 |
| 3,563,111 | 2/1971 | Zeigler | 74/512 |
| 3,643,525 | 2/1972 | Gibas | 74/512 |
| 3,765,264 | 10/1973 | Bruhn, Jr. | 74/512 |
| 3,798,995 | 3/1974 | Schroter | 74/512 |
| 3,828,625 | 8/1974 | Bruhn, Jr. | 74/512 |
| 4,683,977 | 8/1987 | Salmon | 180/334 |
| 4,870,871 | 10/1989 | Ivan | 74/513 |
| 4,875,385 | 10/1989 | Sitrin | 74/512 |
| 4,989,474 | 2/1991 | Cicotte et al. | 74/512 |
| 5,010,782 | 4/1991 | Asano et al. | 74/512 |
| 5,078,024 | 1/1992 | Cicotte et al. | 74/513 |
| 5,086,663 | 2/1992 | Asano et al. | 74/512 |

FOREIGN PATENT DOCUMENTS 952831 3/1964 United Kingdom .

*Primary Examiner*—Vinh T. Luong

*Attorney, Agent, or Firm*—Remy J. VanOphem

[57] ABSTRACT

An adjustment device for an automobile control pedal which is capable of pivotably adjusting the control pedal relative to a datum point, such as the eyelet of a cylinder pushrod. The adjustment device allows the control pedal to be optimally positioned to suit the needs of a particular driver. The preferred control pedal can be pivotably attached to a frame in any conventional manner, such as with a pivot pin. The adjustment device is mounted alongside the control pedal and to the pushrod eyelet without the need of additional support hardware other than a link for maintaining a predetermined distance between the pushrod eyelet and the pivot pin of the control pedal. Consequently, the adjustment device can be readily adapted to fit conventional control pedal assemblies without significant modification. The adjustment device includes a camming device which slidably abuts the pedal arm such that rotation of the camming device causes pivotable movement of the pedal arm relative to the datum point. The camming device axis of rotation is preferably maintained a predetermined distance from the pivot of the control pedal arm by a spacing device, such as a link. The adjustment device also includes a cam driving device for rotating the camming device about its axis of cam rotation to produce a corresponding displacement of the control pedal arm about the axis of arm rotation.

15 Claims, 2 Drawing Sheets

ADJUSTABLE AUTOMOBILE PEDAL SYSTEM

BACKGROUND OF THE INVENTION

1. Field of the Invention

The present invention generally relates to automobile control pedals, such as brake, clutch and accelerator pedals. More specifically, this invention relates to an adjustable automobile control pedal system whose pedals can be selectively adjusted to allow optimal positioning of the pedals relative to the driver of the automobile.

2. Description of the Prior Art

Automobiles are conventionally provided with foot-operated control pedals, such as an accelerator, brake and clutch pedal, which are used to control the motion and speed of the automobile. Typically, these control pedals are permanently fixed to the vehicle chassis and rotate away from the driver when foot pressure is applied, and are not adjustable relative to the driver or their respective attachment points. Consequently, the control pedals must generally be attached so as to be positioned relative to the floor of the passenger compartment to afford operation which is adequately comfortable for the "average" driver. However, some adjustment of the driver relative to the control pedals is clearly desirable.

Though the driver's seat is usually mounted so as to be slidable in a fore and aft direction to accommodate drivers of different physiques, such an arrangement is only partially effective in positioning the driver relative to the control pedals. Seat adjustment allows the driver to position himself or herself relative to the automobile's steering wheel and the control pedals, to some degree improving the driver's comfort and facilitating the driver's ability to operate the vehicle's primary controls. However, it is nearly impossible for such a solution to accommodate all possible variations in the human frame. In particular, proportional differences between the lengths of a driver's arms, legs and feet in relation to the driver's overall physique cannot be readily accommodated by merely adjusting the seat fore and aft with respect to the control pedals. Accordingly, it has been recognized that some form of control pedal adjustment is desirable to provide optimal comfort to the driver while also ensuring that the driver can fully operate the control pedals at all times.

Many approaches to providing adjustable control pedals have been suggested in the prior art. One approach is to provide some form of ratchet device which allows the entire control pedal assembly to rotation about a primary pivot point. This approach rotates a frame to which the control pedals are each rotatably attached, thus providing rotation of the control pedals in unison relative to the driver. Examples of this approach are illustrated in U.S. Pat. Nos. 3,282,125 to Dully; U.S. Pat. No. 3,400,607 to Smith; and U.S. Pat. No. 3,563,111 Zeigler. A similar approach is to mount one or more control pedals to a frame which is slidable fore and aft as a unit relative to the driver, as illustrated in U.S. Pat No. 2,860,720 to Huff et al and U.S. Pat. No. 4,683,977 to Salmon, and British Patent No. 952,831 to Mussell. Yet another suggested approach is a variation on the two previously mentioned, employing a screw-actuated device to displace a frame to which one or more control pedals are rotatably mounted. The screw-actuated device can be used to either rotate the entire frame about a pivot point, as shown in U.S. Pat. No. 3,151,499 to Roe, or the screw-actuated device can displace the frame fore and aft, as illustrated by U.S. Pat. No. 3,301,088 to White; U.S. Pat. No. 3,643,525 to Gibas; U.S. Pat. No. 3,765,264 to Bruhn, Jr.; U.S. Pat. No. 4,870,871 to Ivan; U.S. Pat. No. 4,875,385 to Sitrin; and U.S. Pat. No. 4,989,474 to Cicotte et al. Typically, the screw-actuated device is disclosed to be driven by an eccentric motor which allows the control pedals to be selectively adjusted by the driver from an appropriate control switch mounted on the dashboard of the vehicle within the driver's reach.

As can be readily appreciated by those skilled in the art, the above examples all require substantial hardware and space beneath the automobile's instrument panel to accommodate the device providing the adjustment feature. Much of the necessary additional hardware can be attributed to the need to avoid effecting the operation of the brake and/or clutch pedals, during adjustment, with their respective hydraulic cylinders. Specifically, the approach chosen must avoid causing the pushrods which actuate the respective cylinder pistons to be displaced relative to their cylinders so as to ensure non-engagement of the brakes and/or the clutch.

In addition, it is generally preferable that the approach chosen have no affect on the mechanical advantage of the control pedal as determined by the control pedal's orientation relative to the pushrod. Generally, the mechanical advantage of a control pedal can be described as the relative effort required to apply the control pedal as compared to the actual force required to actuate the device controlled by the control pedal. For instance, mechanical advantage can be improved by moving the contact point between the control pedal and the cylinder's pushrod toward the pivot point of the control pedal.

To avoid changing the mechanical advantage, the adjustable control pedal assemblies of the prior art generally teach a device in which the control pedals are independently adjusted so as to produce an adverse effect with respect to repositioning of the pedal pivot point relative to the pushrods of the respective operating cylinders, as can be seen with the teachings of Cicotte et al. Alternatively, the adjustment device must be provided with a mechanism which simultaneously adjusts the length of the pushrod to accommodate the displacement of the control pedal assembly, as seen with the teachings of Bruhn, Jr.

Though regarding an unrelated and non-analogous problem associated with optimizing the mechanical advantage of a control pedal, U.S. Pat. No. 3,798,995 to Schroter teaches the use of a variable-ratio control pedal utilizing a camming contour for amplifying the mechanical advantage of the control pedal in the latter stages of the control pedal stroke. The intent with such a device is to maximize the driver's braking capability without the need for excessive forces applied to the control pedal. However, the teachings of Schroter are directed entirely toward achieving an optimal mechanical advantage and do not provide any adjustment of the control pedals with respect to the driver. Further, Schroter does not teach or suggest a solution to the problem of adjusting the positions of the control pedals, nor does Schroter even recognize the problem to which the above prior art is directed.

From the above discussion, it can be readily appreciated that the prior art does not disclose an automobile control pedal arrangement which can be adjusted to adapt to the particular physiological requirements of a driver, while simultaneously avoiding the requirement of mounting the entire control pedal assembly to a frame which is either pivotable or displaceable relative to the driver. Nor does the prior art teach or suggest an apparatus which entails minimal additional hardware to achieve suitable adjustment of one or more control pedals to the effect that no repositioning of the prior art pivot point locations is required and, therefore, no significant structural changes need be made to a conventional control pedal arrangement.

Accordingly, what is needed is a cost-efficient adjustment device for adjusting one or more automobile control pedals, the adjustment device being capable of spatially adjusting the control pedals without repositioning the pivot attachment of the conventional control pedal arrangement to adapt to the physiological demands of a driver, while simultaneously requiring minimal structural reinforcements and modifications to achieve the desired results.

SUMMARY OF THE INVENTION

According to the present invention there is provided an adjustment device for one or more automobile control pedals. The adjustment device is capable for pivotably adjusting, utilizing the conventional pivot point position of the control pedal to adjust one or more control pedals independently or in unison relative to a predetermined datum point. The datum point is preferably the pivot eyelet of the master cylinder pushrod for the clutch and/or brake pedals due to the need to leave the operation of the clutch and brake master cylinders unaltered during adjustment of the respective control pedals. In that the accelerator pedal is typically pivotably mounted to the firewall and actuates a flexible cable by which the fuel system is operated, the datum point may be any suitable reference point which allows conventional operation of the accelerator pedal with respect to the flexible cable. Being adjustably pivotable in this manner, the control pedals be be optimally positioned to suit the needs of a particular driver.

Conventionally, each control pedal includes an arm which is pivotably attached to a frame member beneath the automobile's instrument panel by means of a pivot pin and bushing or the like. Where the control pedal is the brake or clutch pedal, the adjustment device of the present invention is mounted alongside the conventional control pedal arm and pivotally attached at the datum point, such as the eyelet of the cylinder pushrod, without the need of any additional support hardware other than a device for maintaining a predetermined distance between the eyelet of the pushrod and the pivot attachment of the control pedal arm. Consequently, the adjustment device can be readily adapted to fit conventional control pedal assemblies without significant modification.

The adjustment device includes a camming device, such as a disc-shaped cam having a predetermined camming contour. The automobile pedal arm slidably abuts the camming device such that rotation of the camming device about its datum point causes pivotable movement of the automobile pedal arm relative to the datum point. By example, where the control pedal is the brake pedal, the brake pedal arm is displaced relative to the brake master cylinder's pushrod eyelet by the camming device.

The camming device preferably has its axis of rotation coincident with the axis of the pushrod eyelet and substantially parallel to the control pedal arm's axis of rotation about its corresponding pivot. The axis of rotation of the camming device is maintained a predetermined distance from the pivot of the control pedal arm by a spacing device, such as a link. By maintaining this predetermined distance, the axes of the camming device and the pushrod eyelet are properly maintained relative to the control pedal arm to maintain a preferred constant mechanical advantage for the control pedal arm.

The adjuster device also includes a cam driving device for rotating the camming device about its axis of rotation. When the driving device causes the camming device to rotate, the camming contour of the camming device produces a corresponding displacement of the control pedal arm relative to its datum point. Thus, the control pedal arm is rotated relative to its respective pushrod eyelet, and thereby can be selectively adjusted relative to the driver of the automobile. As noted above, the link prevents any change in the spatial positioning of the pushrod eyelet to the pivot of the control pedal arm, preventing any change in the mechanical advantage of the control pedal. Further, there is no change in the position of the pushrod relative to the pushrod's corresponding cylinder to produce a partial application of the device which the control pedal operates.

According to a preferred aspect of this invention, both the camming device and one end of the link are mounted directly to the eyelet of the pushrod, while the opposite end of the link is mounted to the control pedal arm's pivot point so as to be alongside the control pedal arm. In addition, the cam driving device is pivotably mounted relative to the control pedal arm. With this construction and arrangement, minimal additional hardware is necessary to implement the adjustment device of the present invention on conventional automobile control pedal assemblies. Consequently, little additional space is required to fit the hardware associated with the adjustment device in the conventional mounting space of the vehicle.

In addition, no independent adjustment is necessary to maintain the position of the cylinder pushrod relative to its cylinder in that the adjustment device of the present invention provides control pedal adjustment with respect to the cylinder pushrod and does not require any relocation or cause any movement of the cylinder pushrod itself. The cylinder pushrod provides a stationary datum point throughout the adjustment of the control pedal with mechanical contact between the camming device and the control pedal arm being maintained such that the control pedal is displaced with respect to the cylinder pushrod. Accordingly, the operation of the pushrod with its cylinder is not affected by the adjustment device of the present invention. Moreover, no change in the mechanical advantage of the control pedal arm results.

In addition, a significant advantage of the present invention is that the cam driving device can be electrically driven by a suitable motor to allow control pedal positioning with one or more controls made accessible on the automobile's instrument panel. With suitable control circuitry, several positions can be placed into a memory device such that a driver can preset an optimal control pedal position for his or her particular frame, allowing automatic recall of the memorized position.

Accordingly, it is an object of the present invention to provide an adjustment device for one or more automobile control pedals which is capable of optimally positioning the control pedals relative to the driver.

It is a further object of the invention that the adjustment device provide pivotable adjustment of the automobile control pedal relative to a predetermined datum, such as the pushrod eyelet of the hydraulic cylinder operated by the control pedal.

It is still a further object of the invention that the adjustment device include a camming device which pivotably rotates the control pedal relative to the predetermined datum to achieve the desired adjustment.

It is another object of the invention that the camming device be positionally maintained relative to the control pedal arm during adjustment so as to maintain a preferred mechanical advantage.

It is yet another object of the invention that the camming device be electrically driven so as to allow the control pedal to be adjusted from a control device which is readily accessible to the driver.

It is still another object of the invention that the adjustment device require minimal additional hardware so as to minimize the structural modifications required to adapt the adjustment device to a conventional automobile control pedal arm.

Other objects and advantages of this invention will be more apparent after a reading of the following detailed description taken in conjunction with the drawings provided.

DETAILED DESCRIPTION OF THE PREFERRED EMBODIMENT

Figure 1:
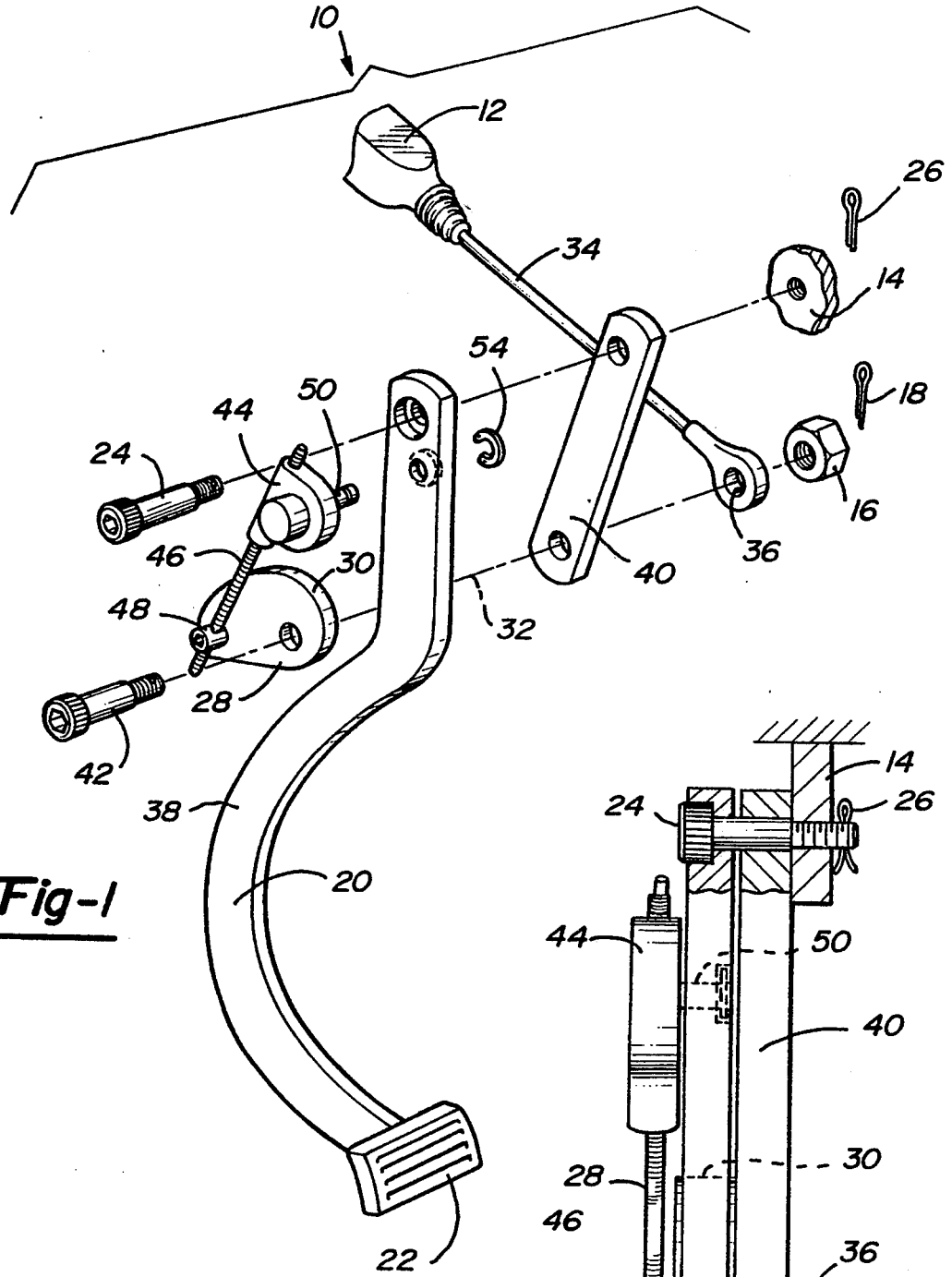
FIG. 1 is an enlarged view of an automobile control pedal unit provided with an adjustment device in accordance with the preferred embodiment of this invention.

With reference to FIG. 1, there is shown an exploded view of an automobile control pedal 10. As illustrated, the automobile control pedal represents a brake or clutch control pedal for actuating a master cylinder 12 located within the engine compartment of the automobile. The following description will specifically refer to the use of the present invention within the environment of a brake or clutch control pedal for purposes of clarity so as to assist in an understanding of the disclosure. However, the teachings of the present invention are not limited to the brake or clutch control pedals of an automobile, and can be readily adapted by one skilled in the art to an automobile's accelerator control pedal (not shown).

Conventionally, the control pedal 10 is suspended just above the compartment floor on the driver's side of the automobile. The control pedal 10 is initially spaced a nominal distance from the driver's seat so as to be operable by a driver having an "average" physique. Conventionally, a driver's seat is adjustable fore and aft so as to bring the driver closer to the control pedal 10, or to displace the driver further from the control pedal 10, respectively, depending upon the driver's particular physique and preference. To supplement the adjustable feature of the driver's seat, an adjustment unit according to the present invention is secured to the control pedal 10.

The control pedal 10 generally includes a pedal arm 20 and a pedal foot pad 22. The pedal arm 20 is typically attached to a frame member 14 located beneath the instrument panel (not shown) of the automobile such that the pedal arm 20 is rotatable in a direction away from the driver. The pedal arm 20 is secured to the frame member 14 by a pivot pin 24 which is shown as a threaded fastener with a cotter key 26 to prevent the pivot pin 24 from becoming loosened from the frame member 14. It may also be preferable to provide a pivot bushing (not shown) in conjunction with the pivot pin 24 to reduce friction between the pedal arm 20 and the frame member 14.

Figure 3:
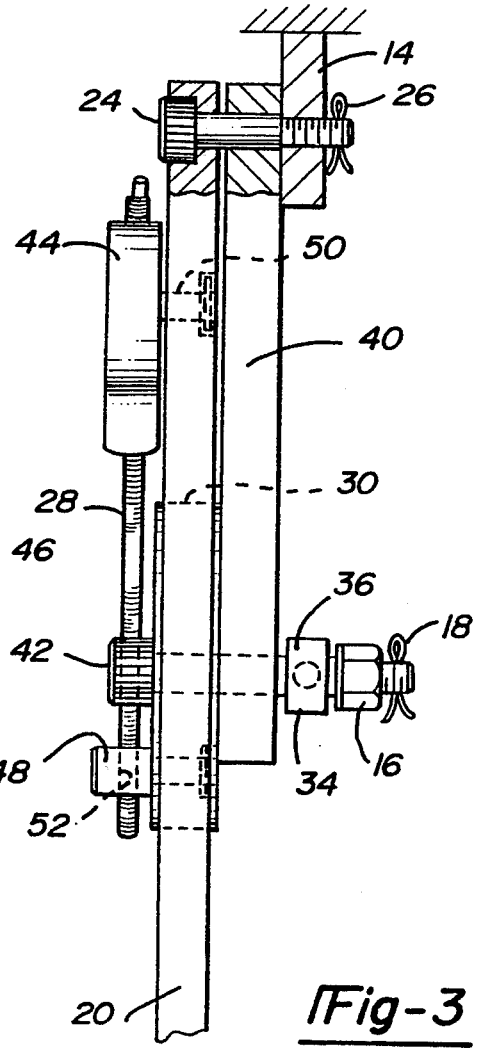
FIG. 3 is a front view of the automobile control pedal unit taken along lines 3—3 of FIG. 2.
Figure 2:
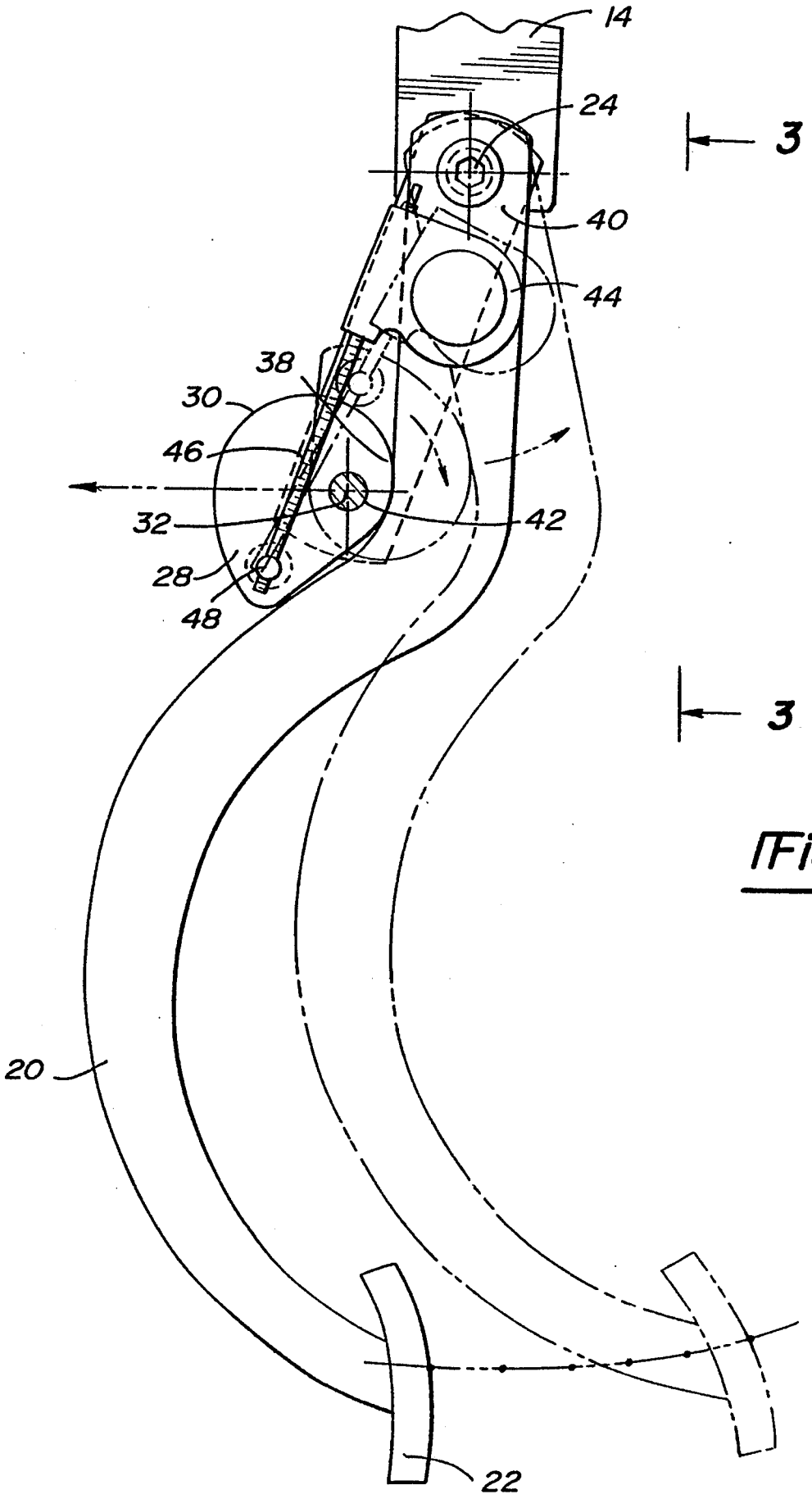
FIG. 2 is a side view of the automobile control pedal unit of FIG. 1 in accordance with the preferred embodiment of this invention.

The pedal arm 20 is typically maintained in a forward position by the biasing effect of a master cylinder pushrod 34 which is conventionally biased toward the automobile's passenger compartment by a spring (not shown) within the master cylinder 12. The pedal arm 20 may also be biased toward the pushrod 34 by a suitable helical spring (not shown) so as to maintain positive engagement between the pedal arm 20 and the pushrod 34. The pushrod 34 is slidable in the axial direction to actuate a piston (not shown) within the master cylinder 12 for purposes of selectively engaging or disengaging the automobile's brakes or clutch, respectively. Conventionally, the pushrod 34 would be rotatably attached directly to the pedal arm 20 with a pivot pin which passes through both pedal arm 20 and an eyelet 36 located on the end of the pushrod 34. However, as can be seen in FIGS. 1 through 3, the pedal arm 20 of the present invention is indirectly actuated by the pushrod 34 through a cam 28. The cam 28 is pivotably attached to the eyelet 36 of the pushrod 34 with a pivot pin 42 such that the cam's axis of rotation 32 coincides with the axes of the pivot pin 42 and the eyelet 36. The pivot pin 42 can be secured to the cam 28 by any suitable means, such as the nut 16 and cotter key 18 shown.

The cam 28 is preferably disc-shaped with a cam contour 30 disposed on an outer surface spaced radially outward from the cam's axis of rotation 32. As best seen in FIG. 2, the cam contour 30 constitutes a significant portion of the cam's outer surface such that the cam 28 can be rotated as much as 180 degrees while still operating within the range of the cam contour 30. The cam contour 30 is slidably disposed against a camming surface 38 provided on the forward surface of the pedal arm 20. As a results, rotation of the cam 28 causes fore or aft pivoting of the pedal arm 20, depending upon the cam's direction of rotation.

The rate of rotation of the pedal arm 20 is also determined by the cam contour 30. Depending upon the preferred control parameters with which the pedal arm 20 is to be adjusted relative to the driver's seat, the cam contour 30 can be radially spaced from the cam's axis of rotation 32 so as to cause a constant rate of rotation of the pedal arm 20 given a constant rate of rotation of the cam 28. Alternatively, the cam contour 30 can be shaped to provide a rate of rotation which varies as the pedal arm 20 rotates, providing finer adjustment of the pedal arm 20 where the pedal arm's rate of rotation is lowest.

As can be best seen in FIGS. 1 and 3, the position of the cam 28 relative to the pedal arm 20 is maintained by a pivot link 40 which extends between the cam's axis of rotation 32 and the pivot of the pedal arm 20 as defined by the pivot pin 24. Preferably, the pivot link 40 is pivotably attached at its upper end to the frame member 14 with the pivot pin 24 so as to extend alongside the pedal arm 20. The lower end of the pivot link 40 can be secured to the cam 28 with the cam pivot pin 42, coinciding with the cam's axis of rotation 32. As such, the pivot link 40 ensures that the cam 28 will remain positioned to cam against the camming surface 38 of the pedal arm 20. With the biasing effect of the pushrod 334, positive contact can be maintained at all times between the cam surface 30 of the cam 28 and the pedal arm surface 338 of the pedal arm 20 to ensure positive mechanical action therebetween. As previously noted, a helical spring (not shown) can also be provided to either act upon the pedal arm 20 to bias the pedal arm 20 against the cam 28, or act through the pivot link 40 to bias the cam 28 against the pedal arm 20. In addition, the pivot link 40 prevents the rotation of the cam 28 from altering the position of the pushrod eyelet 36, and thereby the pushrod 34, relative to the master cylinder 12. Accordingly, any articulation of the pushrod 34 is avoided during the adjustment made to the pedal arm 20 by the cam 28.

As shown in FIGS. 1 through 3, the rotation of the cam 28 is preferably achieved with a drive motor 44 which actuates a rod or lead screw 46 rotatably engaged with the cam 28. Though any suitable type of drive motor 44 can be used, it is preferable in the environment of an automobile's passenger compartment to use an electric drive motor which generates minimal noise. As illustrated, the drive motor 44 can be pivotably attached directly to the pedal arm 20 by a pivot pin 50 and retained with a C-slip 54. The rod 46 is preferably a helical drive screw 46 which is rotated by the drive motor 44. The helical drive screw 46 is pivotably attached to the cam 28 with a pivot pin 48 pivotably secured to the cam 28. The helical drive screw 46 is threadably engaged with a diametrically threaded bore 52 (shown in FIG. 3) through the pivot pin 48 which is oriented to be perpendicular to the pivot axis of the pivot pin 48. Consequently, when the helical drive screw 46 is rotated by the drive motor 44, the pivot pin 48 is driven up or down the length of the helical drive screw 46, depending upon the direction of rotation of the helical drive screw 46. As the pivot pin 48 follows the helical drive screw 46, the cam 28 is forced to rotate about its axis of rotation 32, causing a corresponding rotation in the pedal arm 20 relative to the cam's axis of rotation 32 and the pushrod eyelet 36.

A significant advantage of the adjustment device of the present invention is that by selectively energizing the drive motor 44, the cam 28 can be rotated to select an optimal fore or aft position of the pedal arm 20 relative to the needs of the driver. Consequently, not only can the driver adjust the driver's seat to position himself or herself relative to the control pedal 10, but the driver can also adjust the control pedal 10 itself such that it is positioned to provide optimal comfort to the driver. The use of the invention may result in significant simplification of seat adjuster mechanisms since the function of providing adjustment of the seat to enable reaching of the pedals need no longer be considered. The control pedal with this invention will be pivotally adjustable towards the seat.

In addition, where all of the automobile's control pedals—namely, the brake, clutch and accelerator pedals—are provided with the adjustment device of the present invention, each control pedal can be adjusted individually or collectively so as to provide optimal positioning of the control pedals for the particular physique of the driver. The control pedals 10 can be independently adjusted, or the drive motors 44 for each control pedal 10 can be controlled by a single electronic device (not shown) which appropriately adjusts the individual control pedals 10 according to a single command initiated by the driver. Under some circumstances, a single drive motor 44 could be used to rotate cams 28 which are each assigned to an individual control pedal 10. With either approach, the controls for the drive motor 44, and thus the adjustment of each control pedal 10, can be located to be accessible to the driver, such as on the automobile's instrument panel.

Another significant advantage of the present invention is that metal-to-metal contact is assured to provide positive actuation between the pedal arm 20 and the master cylinder pushrod 34 at all times without the need for significant additional structure. The cam 28 is pivotably secured to the pushrod 34 such that the cam 28 is maintained in metal-to-metal contact with the pedal arm 20 either by the biasing effect of the pushrod 34 alone, or as supplemented by a helical spring which urges the pedal arm 20 against the cam 28. Moreover, the cam's axis of rotation 32 coincides with the axis of the pushrod eyelet 36 and is maintained a predetermined distance from the pivot pin 24 of the pedal arm 20 by the pivot link 40 such that the cam 28 and the pushrod 34 are properly maintained relative to the pedal arm 20 to maintain a constant preferred mechanical advantage. Also, there is no movement of the pushrod 34 relative to the pushrod's corresponding master cylinder 12 during adjustment of the control pedal 10, thereby preventing the control pedal's adjustment from causing partial operation of the device which it controls.

In addition, the advantages of the adjustment device can be realized with minimal additional hardware and can be readily adapted to a conventional control pedal. Accordingly, excessive space beneath the instrument panel is not required to accommodate the adjustment device, nor is there a significant penalty in terms of added weight.

Accordingly, the present invention provides an automobile control pedal adjustment device which is readily adaptable to conventional automobile control pedals for selective adjustment of the control pedals relative to the driver's seat, supplementing the adjustment capability conventionally provided with a driver's seat. The control pedal adjustment device can be actuated with a switch conveniently located on the instrument panel to position the control pedals according to the desires of the driver. The adjustment device can be electrically operated and can be provided with controls which are integrated with the central control module of the automobile to provide a memory capability, allowing several drivers to store a preselected control pedal position that can be recalled.

While the invention has been described in terms of a preferred embodiment, it is apparent that other forms could be adopted by one skilled in the art. For example, the cam 28 could be positionally maintained by any other suitable device so as to assure that the pushrod 34 is positively actuated by the control pedal 10, regardless of the adjustment to the control pedal 10. Additionally, other means for rotating the cam 28 can be readily adopted by those skilled in the art to achieve the adjustment of the control pedal as described. Accordingly, the scope of the invention is to be limited only be the following claims.

What is claimed is:

1. A method for adjusting an automobile pedal arm adapted to rotate about an axis of arm rotation, said method comprising the steps of:

positioning camming means, having an axis of cam rotation, juxtaposed said automobile pedal arm;

positioning said axis of cam rotation a predetermined distance from said axis of arm rotation; and rotating said camming means about sid axis of cam rotation such that said automobile pedal arm is rotatively displaced relative to said axis of arm rotation.

2. The method of claim 1 wherein said step of rotating includes rotating said camming means with a drive shaft which is rotatably driven by a drive motor.

3. The method of claim 1 further comprising the step of maintaining a constant distance between said axis of cam rotation and said axis of arm rotation.

4. An adjustment device for adjusting a pedal arm adapted to rotate about an axis of arm rotation, said adjustment device comprising:

camming means rotatably mounted juxtaposed said pedal arm for rotating said pedal arm about said axis of arm rotation, said camming means having an axis of cam rotation;

means for locating said axis of cam rotation a predetermined distance from said axis of arm rotation, said locating means having one end pivotably mounted substantially concentric with said axis of arm rotation such that rotation of said camming means rotates said pedal arm about said axis of arm rotation; and drive means juxtaposed said camming means, said drive means having a projecting portion engaging said camming means for driving said camming means about said axis of can rotation;

whereby rotation of said camming means about said axis of cam rotation causes said pedal arm to be rotatively displaced about said axis of arm rotation.

5. The adjustment device of claim 4 wherein said axis of cam rotation is substantially parallel to said axis of arm rotation.

6. The adjustment device of claim 4 wherein said camming means is a disc having a camming surface radially spaced from said axis of cam rotation, said camming surface slidably contacting said pedal arm.

7. The adjustment device of claim 4 wherein said means for locating comprises a link extending between said axis of arm rotation and said axis of cam rotation, said link having one end pivotably connected to said pedal arm at said axis of arm rotation and an opposite end pivotably connected to said camming means at said axis of cam rotation.

8. The adjustment device of claim 7 wherein said drive means comprises:

a drive motor pivotably attached to said pedal arm; and wherein said projecting portion comprises a helical drive shaft having one end rotatably engaged with said drive motor and an opposite end pivotably secured to said camming means at a location spaced from said axis of cam rotation, said helical drive shaft rotating said camming means in one direction when said drive motor is driven in a first direction, said helical drive shaft further rotating said camming means in a direction opposite to said one direction when said drive motor is driven in a second opposite direction.

9. The adjustment device of claim 4 wherein said drive means comprises:

a drive motor pivotably attached to said pedal arm; and wherein said projecting portion comprises a helical drive shaft having one end rotatably engaged with said rive motor and an opposite end pivotably secured to said camming means at a location spaced from said axis of cam rotation, said helical drive shaft rotating said camming means in one direction when said drive motor is driven in a first direction, said helical drive shaft further rotating said camming means in a direction opposite to said one direction when said drive motor is driven in a second opposite direction.

10. An adjustment device for adjusting an automobile pedal arm adapted to rotate about an axis of arm rotation, said adjustment device comprising:

camming means rotatably mounted juxtaposed said automobile pedal arm for rotating said automobile pedal arm about said axis of arm rotation, said camming means having an axis of cam rotation substantially parallel to said axis of arm rotation, said camming means further having a camming surface slidably contacting said automobile pedal arm;

means for locating said axis of cam rotation a predetermined distance from said axis of arm rotation, said locating means having one end pivotably mounted substantially concentric with said axis of arm rotation; and drive means mounted to said automobile pedal arm for rotating said camming means about said axis of cam rotation;

whereby rotation of said camming means about said axis of cam rotation causes said camming surface to urge said automobile pedal arm to be rotatively displaced about said axis of arm rotation.

11. The adjustment device of claim 10 wherein said camming means is a disc and wherein said camming surface radially spaced from said axis of cam rotation and slidably engages said automobile pedal arm.

12. The adjustment device of claim 10 wherein said means for locating comprises a link extending between said axis of arm rotation and said axis of cam rotation, said link having one end pivotably connected to said automobile pedal arm at said axis of arm rotation and an opposite end connected to said camming means at said axis of cam rotation.

13. The adjustment device of claim 10 wherein said drive means comprises:

a drive motor pivotably attached to said automobile pedal arm; and a helical drive shaft having one end rotatably engaged with said drive motor and an opposite end pivotably secured to said camming means at a location spaced a predetermined distance from said axis of cam rotation, said helical drive shaft rotating said camming means in one direction when said drive motor is driven in a first direction, said helical drive shaft further rotating said camming means in a direction opposite said one direction when said drive motor is driven in a second opposite direction.

14. The adjustment device of claim 12 further comprising a cylinder pushrod having one end attached to said opposite end of said link; and means for connecting said one end of said pushrod and said opposite end of said link about said axis of cam rotation.

15. The adjustment device of claim 12 wherein said drive means comprises:

a drive motor pivotably attached to said automobile pedal arm; and a helical drive shaft having one end rotatably engaged with said drive motor and an opposite end pivotably secured to said camming means at a location spaced a predetermined distance from said axis of cam rotation, said helical drive shaft rotating said camming means in one direction when said drive motor is driven in a first direction, said helical drive shaft further rotating said camming means in a direction opposite said one direction when said drive motor is driven in a second opposite direction.

* * * * *

UNITED STATES PATENT AND TRADEMARK OFFICE

CERTIFICATE OF CORRECTION

PATENT NO. : 5,351,573
DATED : October 4, 1994
INVENTOR(S) : Edmond B. Cicotte

It is certified that error appears in the above-indentified patent and that said Letters Patent is hereby corrected as shown below:

Title page, item [57], line 6, delete ---- preferred ----.

item [57], line 8, after "The" insert ---- preferred----.

Column 1, line 51, delete "rotation" insert ---- rotate ----.

Column 1, line 58, after "3,563,111" insert ---- to ----.

Column 2, line 40, insert "an" delete ---- no ----.

Column 3, line 25, delete "for" insert ---- of ----.

Column 3, line 40, delete "be" first occurrence insert ---- can ----.

Column 5, line 29, delete "enlarged" insert ---- exploded ----.

Column 6, line 26, after "both" insert ---- the ----.

Column 6, line 45, delete "results" insert ---- result ----.

Column 7, line 5, delete "334" insert ---- 34 ----.

Column 7, line 7, delete "338" insert ---- 38 ----.

Column 7, line 28, delete "C-slip" insert ---- C-clip ----.

UNITED STATES PATENT AND TRADEMARK OFFICE

CERTIFICATE OF CORRECTION

PATENT NO. : 5,351,573

DATED : October 4, 1994

INVENTOR(S) : Edmond B. Cicotte

It is certified that error appears in the above-indentified patent and that said Letters Patent is hereby corrected as shown below:

Column 8, line 63, delete "be" second occurrence insert ---- by ----.

Column 9, line 5, delete "sid" insert ---- said ----.

Column 9, line 32, delete "can" insert ---- cam ----.

Column 10, line 3, delete "rive" insert ---- drive ----.

Column 10, line 37, after "surface" insert ---- is ----.

Signed and Sealed this

Third Day of January, 1995

Bruce Lehman

*Attest:*

BRUCE LEHMAN

*Attesting Officer*

*Commissioner of Patents and Trademarks*